US005480064A

United States Patent [19]

Yan

[11] Patent Number: 5,480,064

[45] Date of Patent: Jan. 2, 1996

[54] DISPENSING SYRINGE FOR A FLUID GLUE

[76] Inventor: Yi-Tsung Yan, P.O. Box 96-405, Taipei, Taiwan, 10098

[21] Appl. No.: 368,325

[22] Filed: Jan. 4, 1995

[51] Int. Cl.[6] ..... B67D 5/00

[52] U.S. Cl. ..... 222/83; 222/542

[58] Field of Search ..... 222/81, 83, 83.5, 222/89, 108, 151, 190, 420, 421, 148, 541.2, 546, 542, 563

[56] References Cited

U.S. PATENT DOCUMENTS

| | | | |
|---|---|---|---|
| 3,314,429 | 4/1967 | Boehm et al. | 222/83 |
| 4,456,150 | 6/1984 | Yang | 222/83 |
| 5,156,303 | 10/1992 | Yamamoto et al. | 222/81 |

FOREIGN PATENT DOCUMENTS

| | | | |
|---|---|---|---|
| 4219103 | 12/1993 | Germany | 222/83 |
| 81215092 | 5/1993 | Taiwan . | |
| 2135290 | 8/1984 | United Kingdom | 222/81 |

*Primary Examiner*—William A. Cuchlinski, Jr.
*Assistant Examiner*—Philippe Derakshani

[57] ABSTRACT

An improved dispensing syringe for a fluid glue, which comprises a syringe stem, a syringe seat, a syringe cap, a guide sleeve and a sealing pad; the syringe seat has a conic cylindrical opening at one end, and a contact surface and a guide hole on the other end thereof; one end of the syringe stem has a bevel opening, being mounted in the center of the conic cylinder opening while the other end thereof is a flat opening, being set out of the syringe seat. There is a given length between the flat opening and the syringe seat. The syringe stem and the syringe seat are connected together by glue. The dispensing syringe is mounted to the conic cylinder on the container with a stinging through method so as to draw the glue to flow out. The inside of the syringe cap is mounted with a guide sleeve and sealing pad; the syringe cap is used for closing the syringe stem after dispensing the glue each time; the guide sleeve is used for guiding the front end of the syringe stem to move in the center of the sealing pad, i.e., to have the flat opening isolated from the atmosphere by means of a blind hole in the sealing pad so as to prevent the cyanoacrylate from contact the atmosphere. The glue in the container can be used again upon the syringe cap being removed. In case of the sealing pad being out of order or missing, a polymerizing curved surface in the front end of the syringe stem will cause the glue to be polymerized as a sealing of the container.

4 Claims, 4 Drawing Sheets

DISPENSING SYRINGE FOR A FLUID GLUE

BACKGROUND OF THE INVENTION

1. Field of the Invention

This invention relates to a dispensing syringe, and particularly to a dispensing syringe for dispensing a fluid glue made of cyanoacrylate.

2. Description of the Prior Art

In the conventional glue, such as Alkyl-2-cyanoacrylate which is usually referred as instant glue or three-second glue, the cyanoacrylate can quickly be polymerized at room temperature without adding catalyst. Suck quick polymerization is caused by a weak-base substance to make an anionic polymerization. Since such glue has a strong gluing force, it is subject to causing a preservation and storage problem in a container after each use.

Conventionally, the glue of cyanoacrylate is loaded in a container made of a high density polyethylene; in order to facilitate dripping, such container is furnished with an elongate dripping tube on the sealing cap or the like; the dripping tube is to be closed with a cap. According to the aforesaid package, the outer end of the dripping tube is sealed completely. Before the first time use, the sealed outer end of the dripping tube has to be stabbed through with a needle point, i.e., to make a fine hole; then, the fine hole is subject to being blockaded or sealed With the glue therein; in that case, the fine hole will be unable to stab through with a needle; the only way to open such dripping tube is to cut off a small part thereof so as to let the glue drip out again. After one part of the front end of the dripping tube is cut off, the hole of the dripping tube will be larger than the last one to result in having more air to enter the container; as a result, the glue in the container will soon become polymerized and solidified, i,e., becoming useless.

In a conventional point-gluing machine, the dispensing syringe is mounted to the front end of a dispensing tube of such machine; the dispensing syringe comprises a syringe stem and a syringe seat; both ends of the syringe stem are flat openings; one end thereof is inserted into the center of: the syringe seat, while the other end thereof extends at a suitable length for dispensing a glue. The syringe seat is fastened, with a screw-method, to the front end of a dispensing tube of the point-gluing machine. The dispensing quantity of the glue is controlled with the point-gluing machine. If the dispensing syringe of, the point-gluing machine is tried to mounted on a glue container, it will be impossible because of the dripping tube on the front end opening of the container is not provided with a conic cylinder opening, i.e., the dispensing syringe is unable to be mounted to a container for containing cyanoacrylate glue.

Since the dripping tube of the conventional glue container is a sealed type of dripping tube, i.e., having no a through hole to let the dispensing syringe to insert therein, one end of syringe stem of the dispensing syringe is provided with a bevel opening, which extends into the center of the conic cylinder opening. Since the dispensing syringe is inserted into the elongate dripping tube with stabbing method, which has been disclosed in a Taiwan patent application Ser. No. 81215092, in which a dispensing syringe has a bevel opening to be stabbed into the front end center of an elongate dripping tube on the container so as to let a glue therein flow out. In practise, the bevel opening is stabbed into the front end of the container, but the outer atmosphere is subject to entering the container if the front end of the dripping tube is not quite fitted with the conic cylinder opening, i.e., the outer surface of the dripping tube is unable to have an airtight contact with the conic cylinder opening of the syringe seat; in that case, the front end of the dripping tube and the bevel opening will be sealed by the glue after being solidified. Since the inner surface of the syringe stem is a smooth surface, the syringe stem is subject to being blockaded with the glued solidified, and then the dispensing syringe will become useless.

In the foresaid prior art, a Japan manufacturer has made a container with a conic cylinder in the front end thereof to fit with the dispensing syringe; of which one end has a bevel opening to stab into the front end of the glue container. The conic cylinder of the container is used for obtaining an airtight contact with the conic cylinder opening of the syringe seat. The inner surface of the syringe stem is a straight and smooth surface to facilitate the glue to flow out. According to the instruction of the aforesaid product, after the glue is used each time, a user should put some mouth water or natural water on the front end of the syringe stem so as to enable the glue to be polymerized as a solidified layer to prevent the atmosphere from contacting the glue (cyanoacrylate) in the container. If the glue has to be used next time, the front end of the syringe stem has to be heated first to have the solidified layer melted before the glue flowing out again. Such methods of having the front end sealed with the polymerization and solidifying, and heating for re-use are usually neglected by user; as a result, the glue in the whole syringe stem will be solidified, and then the whole syringe stem has to be heated for melting the glue. In such a case, before the glue becoming polymerized with a mouth water or natural water, if the container is slightly compressed un-intentionally, a thin film formed with mouth water or natural water will break immediately, and the sealing function of the glue will fail.

Further, the inner surface of the conventional dispensing syringe is a smooth surface, different diameters of dispensing syringes have to be changed to meet actural requirements; otherwise, the dispensing syringe will have a dripping condition, which causes the flowing volume of the glue unable to control.

SUMMARY OF THE INVENTION

The prime object of the present invention is to provide a dispensing syringe with a polymerizing curved surface on the front end of the syringe stem; after a glue made of cyanoacrylate flows through the polymerizing curved surface on the front end of the syringe stem, the glue will cohere on the polymerizing curved surface automatically. After each time of use, a syringe cap is put on the front end; a blind hole of a sealing pad in the syringe cap will seal the flat opening of the syringe stem to prevent the cyanoacrylate from contacting the atmosphere. The glue can be Used again next time upon the syringe cap being removed. In case of the sealing pad being out of order or missing, the polymerizing curved surface of the front end of the syringe stem will cause: the glue to have a polymerization to seal the flat opening so as to blockade the glue from contacting the atmosphere, and to avoid further polymerization so as to preserve the glue for a longer time. The sealed front end of the syringe stem can be opened again by heating the front end with a lighter or the like so as to have the glue flowed out for re-use repeatedly.

Another object of the dispensing syringe according to the present invention is to provide a polymerizing curved surface on the fornt end of the syringe stem. After the glue flows through the polymerizing curved surface, the glue will be cohered on the polymerizing curved surface as a result of the surface tension of the viscosity of the glue, the adhesion between the glue and the inner surface of the syringe stem, and the relative value of cohesion of the glue. As soon as the syringe cap is mounted on the front end, a vacuum space will be formed between the sealing pad and the polymerizing curved surface to cause the glue to stop in the front end of the dispensing syringe, i.e., a suitable amount of glue remaining in the front end. The glue left in the front end will not become solidified within a short moment, and the glue can still flow out upon the syringe cap being removed. If a small amount of atmosphere enters the sealing pad in the syringe cap, the cyanoacrylate in the front end will be polymerized with the atmosphere to seal the flat opening.

Still another object of the present invention is to provide a dispensing syringe, in which the front end of the syringe stem has a polymerizing curved surface for controlling the flow of the glue (cyanoacrylate), and for causing the glue to automatically cohere and seal the flat opening. The flat opening of front end of the syringe stem can also be sealed manually by applying a small amount of mouth water or natrual water, and by putting the syringe cap thereon soon.

A further object of the present invention is to provide a dispensing syringe, in which the polymerizing curved surface in the front end is formed with two radial resistant curved surfaces; each of the resistant curved surfaces is formed with several resistant beads, which are formed into several bead resistant points; a tangent line passing on the outer surface of the bead resistant points forms into the resistant curved surface. The bead resistant points are arranged at a regular space one another, and each pair of opposite beads have a given diameter; by means of such bead resistant points, the flow of glue can be limited. After each dispensing, the glue will be left, cohered on the polymerizing curved surface.

A still further object of the present invention is to provide a dispensing syringe, in which the polymerizing curved surface in the front end of the dispensing syringe is formed with two symmetrical recess curved surfaces, of which each is formed by means of a rod pressed with a mechanical force. Between the two symmetrical recess curved surfaces, there :is a flat throat portion, a convergent portion and a divergent portion, which are used for limiting the flow of glue, and for providing a capillarity effect in the throat portion to cause the glue to be cohered in the throat portion of the polymerizing curved surface.

Yet another object of the present invention is to provide a dispensing syringe, in which a sealing pad is mounted in the syringe cap; the center of the sealing pad has a blind hole, of which the diameter is smaller than that of the front end of the syringe stem. Since the sealing pad is made of an elastic material, the blind hole can close the flit opening upon the front end being inserted therein so as to prevent the cyanoacrylate from contacting the atmosphere; then, the glue can flow out for next time use upon the syringe cap being removed.

Figure 1:
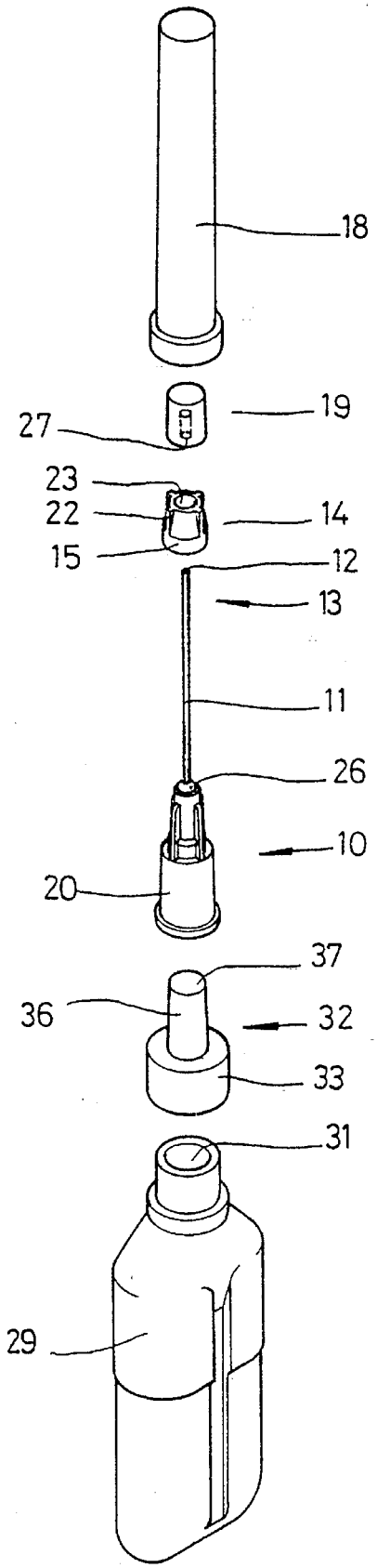
FIG. 1 is a disassembled view of the present invention, showing the structure of the dispensing syringe and the container thereof.
Figure 2:
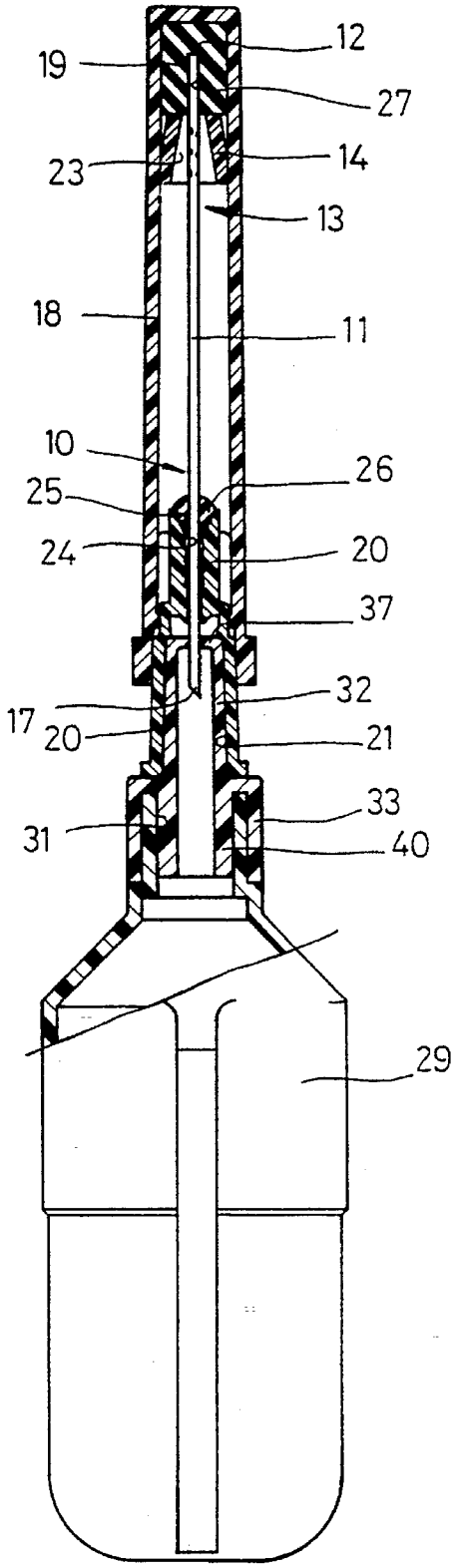
FIG. 2 is a sectional view of the present invention, showing the dispensing syringe mounted on the container thereof.

DETAILED DESCRIPTION OF THE PREFERRED EMBODIMENTS:

Referring to FIGS. 1 and 2, the glue filled in a container 29 of the present invention is a cyanoacrylate as a glue. After the glue is loaded in the container 29 through a filling part 31, a plug 32 is mounted on the filling part 31. The container 29 is made of a poly-propylene through a mold, or made of a high density polyethylene. One end of the plug 32 has a tube portion 40 and an outer cap 33, while the other end thereof has a conic cylinder 36. The plug 32 is fastened to the filling part 31 of the container 29 by means of the tube portion 40. The outer cap 33 is mounted on the outer surface of the filling part 31. The top surface 37 of the conic cylinder 36 is a sealed top so as to have the glue stored in the container under a proper condition. When the glue is to be used, a pin seat 20 of the dispensing syringe 10 will break through the sealed top to let the glue flow out.

Figure 3:
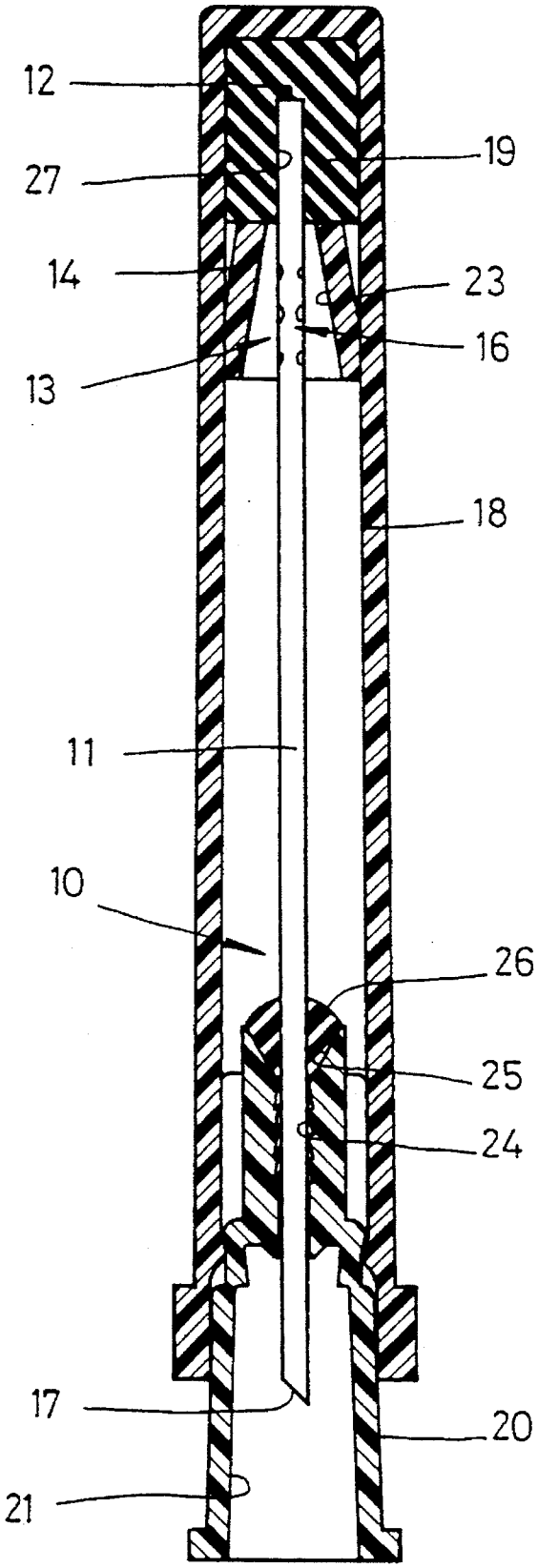
FIG. 3 is a sectional view of the present invention, showing the structure of the dispensing syringe.
Figure 7:
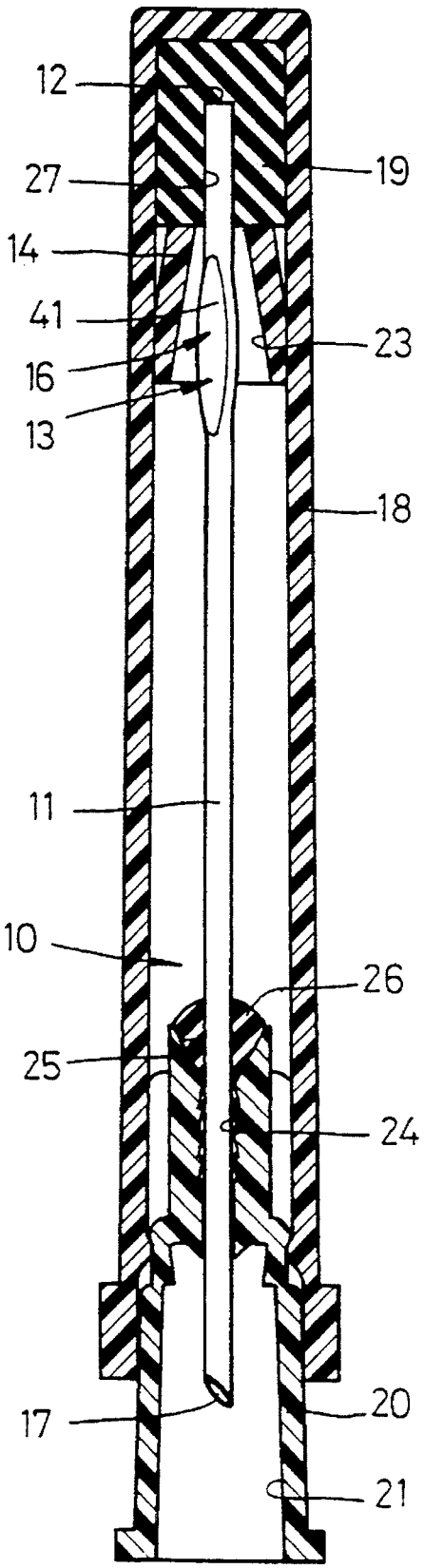
FIG. 7 is a sectional view of an embodiment-2 of the curved surface on the front end of the dispensing syringe according to the present invention.

As shown in FIGS. 1 to 3, the dispensing pin 10 includes a syringe stem 11, a pin seat 20, a pin cap 18, a sealing pad 19 and a guide sleeve 14. One end of the rid of the pin seat 20 has a conic cylinder opening 21, while the other end thereof has a contact surface 25 and a dispensing hole 24. The conic cylinder opening 21 is designed to fit with the conic cylinder 36 of the plug 32 on the container 29. A guiding hole 24 in the syinge seat 20 is used for receiving the syringe stem 11; the contact surface 25 of the guiding hole 24 is to be glued together with the outer surface of the syringe stem 11 by means of a glue. The syringe stem 11 is made of a stainless steel. In terms of medical point of view, a #19 syringe stem is deemed the most suitable one; the outer diameter of the syringe stem is 1.07 millimeter, and the thickness of the syringe stem is 0.15 millimeter. One end of the syringe stem 11 is a flat opening 12, while the other end thereof is a bevel opening 17. The flat opening 12 is referred to as the outer end of the syringe stem; from the flat opening 12 to the syringe seat 20, there is a given length. The bevel opening 17 of the syringe stem is located in the center of the conic cylinder opening 21 of the pin seat 20. The bevel opening 21 of the pin seat 20. The bevel opening 17 has a suitable angle of 30 degree to 45 degree. To mount the syringe stem 11 on the container 29, the conic cylinder opening 21 of the syringe seat 20 has to be fastened to the conic cylinder 36 of the plug 32 on the container 29, i.e., by using the bevel opening 17 of the syringe stem 11 to sting through the top surface 37 of the plug 32 so as to facilitate the syringe stem 11 to guide a glue out of the container 29.

After the dispensing syringe 10 is inserted into the plug 32 of the container 29, the outer end of the dispensing syringe 10 is mounted with a syringe cap 18 to prevent the cyanoacrylate from being in contact with the air to result in becoming a solid through polymerization. The inside of the syringe cap 18 is mounted with a sealing pad 19 and a guide sleeve 14; the guide sleeve 14 is located at the outside of the sealing pad 19. The center of the guide sleeve 14 has a conic through-hole 23, which is used for guiding the dispensing pin 10 and the pin cap 18 to be mated in the center correctly. The center of the sealing pad 19 has a blind hole 17, which is used for closing and sealing the flat opening 12 of the syringe stem 11 after each use and mounting the syringe cap 18 in place so as to facilitate next time use. In case of the sealing pad 19 in the pin cap 18 being out of order or the syringe cap 18 missing, the glue in the syringe stem will become polymerized in the polymerizing curved surface 16 on the front end 13 to close the flat opening of the dispensing syringe 10 automatically.

The syringe cap 18 is made into an elongate cylinder, of which the inside is furnished with a sealing pad 19 and a guide sleeve 14; the sealing pad 19 has a suitable elasticity, and is made of a material being not subject to polymerization with the cyanoacrylate (the glue); a silicon rubber is deemed the best material to meet the aforesaid requirement; the sealing pad 19 is formed into shape by means of a compression molding. The best Duramater hardness value of the sealing pad 19 is 60; The sealing pad 19 has a blind hole 27 facing the opening of the pin cap 18; the blind hole 27 has a given depth, and a diameter being smaller than that of the front end of the syringe stem 11. Since the sealing pad 19 has a given elasticity, it can closely seal the flat opening 12 upon the opening 12 being inserted into the blind hole 27 so as to prevent the cyanoacrylate in the front end 13 of the syringe stem from being in contact with the air. The glue in the container 29 can still be used normally as soon as the syringe cap 18 is removed.

The guide sleeve: 14 is located outside the sealing pad 19; the guide sleeve 14 has a cylindrical surface, several ribs 22, and a conic through-hole 23; between the conic through-hole 23 and the cylindrical surface 15, there is a thin end portion. The guide sleeve 14 has a through hole therein, being slightly bigger than the blind hole 27 of the sealing pad 19. The outer surface of the guide sleeve 14 has several ribs 22, with which the guide sleeve can be fastened inside the syringe cap 18 next the sealing pad 19. The conic through-hole 23 is used for guiding the front end 13 of the syringe stem 11 to enter the blind hole 27 of the sealing pad 19 without bias.

Referring to FIGS. 3 to 6, the front end 13 of the dispensing syringe 10 is furnished with a polymerizing curved surface 16 to prevent the glue from dripping out upon dispensing, and to avoid the glue left in the front end 13 as well. Since the cyanoacrylate (glue) has a given viscosity, the inner surface of the dispensing syringe 10 has a given water miscibility and the outer surface of the glue has very small area, the molecues thereof would have an attractive force among them. The cohesive force among the molecules of the glue will cause a lagging phenomenon and a capillarity phenomenon. After each use of the glue and the syringe cap 18 not being closed soon, the glue in the polymerizing curved surface 16 of the front end 13 of the syringe stem will have a cohesion phenomenon to seal up the opening to prevent the glue in the container 29 from being in contact with the outer atmosphere. If the syringe cap 18 is put back in place after each using time of the glue, the glue in the container 29 will be surely protected from being in contact with the atmosphere, and the glue can be ready used next time upon the syringe cap 18 being removed.

Figure 4:
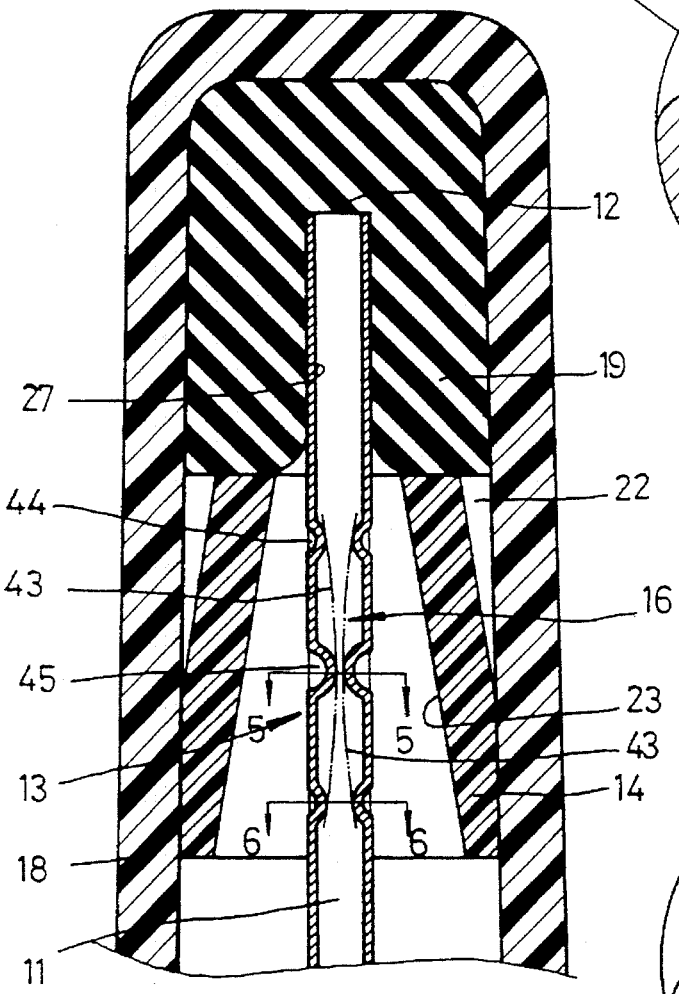
FIG. 4 is a sectional view of an embodiment-1 of the curved surface on the front end of the dispensing syringe according to the present invention.
Figure 5:
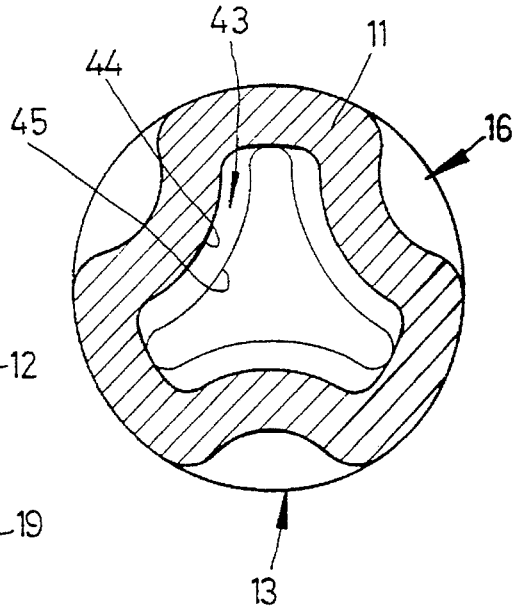
FIG. 5 is a sectional view taken along a line 5—5 of FIG. 4.
Figure 6:
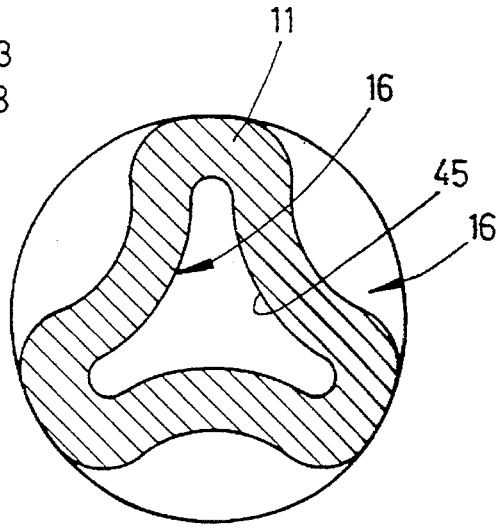
FIG. 6 is a sectional view taken along a line 6—6 of FIG. 4.
Figure 8:
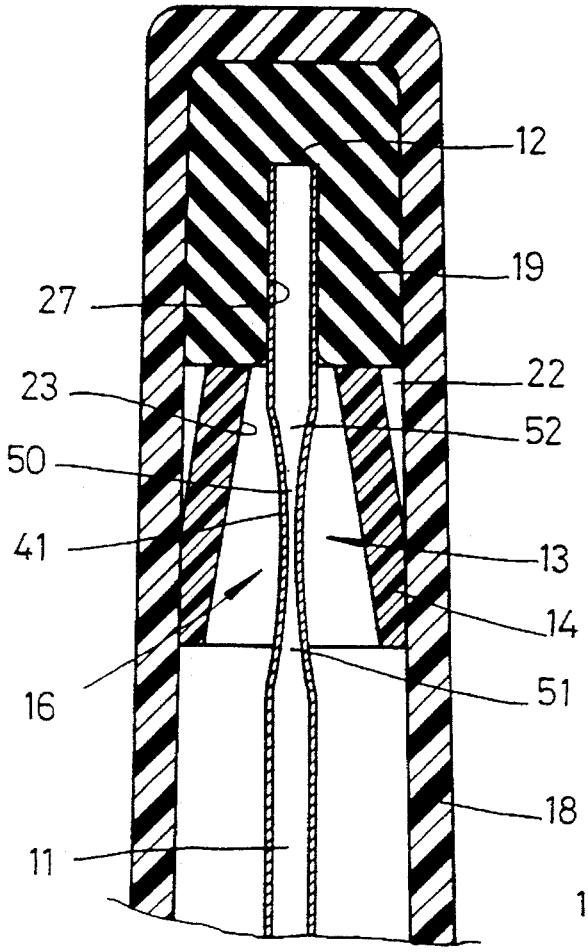
FIG. 8 is a sectional view-1, showing the polymerizing curved surface of the front end of the depensing syringe.
Figure 9:
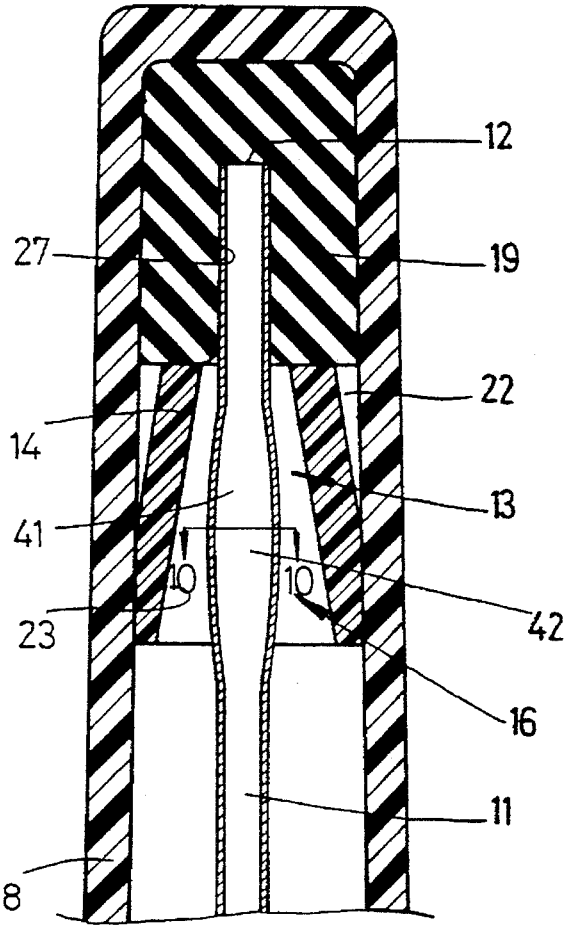
FIG. 9 is a sectional view-2, showing the polymerizing curved surface of the front end of the depensing syringe.
Figure 10:
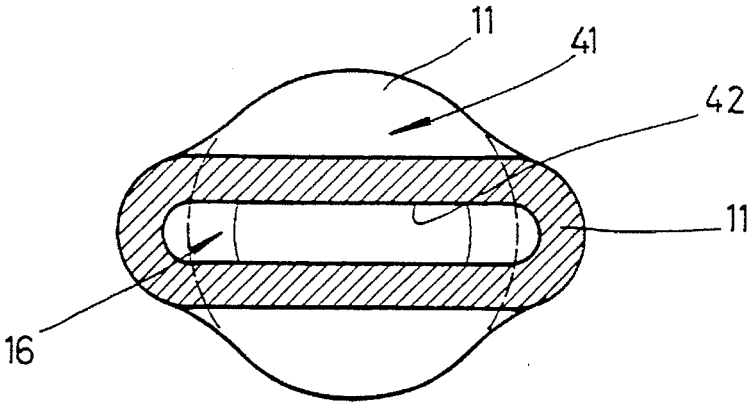
FIG. 10 is a sectional view taken along a line 10—10 in FIG. 9.

The front end 13 of the dispensing syinge 10 has a polymerizing curved surface 16 as shown in FIGS. 4–6; the curved surface 16 is located in the center of the syringe stem 11 of the dispensing syringe 10, being furnished with at least two symmetrical-and-radial resistant curved surfaces 43. The resistant curved surfaces 43 are formed by means of the tangent lines of a plurality of bead resistant points 44; the resistant beads have different diameters, and are arranged at a regular distance each other. The resistant beads 45 in the center portion of the resistant curved surface 43 have the biggest diameter so as to form a smallest sectional area of the syringe stem. When the glue flows through the resistant beads 45 on the resistant curved surface 43, the glue will be limited with a constant flow effect. The radial resistant curved surface 43 is formed by means of a plurality of resistant beads in the front end 13 of the syringe stem. When the glue is being dispensed for use, an inversed flow will take place as result of the negative pressure in the container, i.e., a small part of glue in the front end 13 will be sucked back into the container 29. Since the position of the resistant beads 45 has a very small sectional area, the glue left in that sectional area is unable to be sucked back by means of the pressure balance effect of the container 29 as a result of viscosity of the glue. The glue left on the resistant curved surface 43 will close the syringe stem 11 because of the viscosity of the glue, the water miscibility of the inner surface of the dispensing syringe 10, and the cohesive force of the molecules on that small area of the glue.

The polymerizing curved surface 16 in the front end 13 of the dispensing syringe 10 as shown in FIGS. 7 to 10 is opposite to the front end 13 by means of two symmetrical curved rods, which form a pressure to the surface: of the syringe stem 11, i.e., to form into a channel by means of two symmetrical recess curved surfaces 41 as a throat portion 50 in the center of the front end 13. Both ends of the channel have a convergent portion 51 and a divergent portion 52 respectively. The throat portion 50 is a wide-and-curved flat portion 42, having the smallest sectional area. When a pressure applied to the container 29 is greater than the atmosphere, the glue will flow out of the dispensing syringe 10. As soon as the glue flows through the throat portion 50 on the recess curved surface 41, the flow of the glue will be limited with a constant flow effect. After the glue stops to flow as a result of a pressure applied to the container 29 being removed, the container 29 will have a negative pressure (which is less than an atmosphere), and the glue in the front end 13 will be sucked into the container 29, but only a part thereof is sucked back because of the throat portion 50 having a very small sectional area, and the glue having a given viscosity. The glue left in the divergent portion 52 will close and seal the syringe stem as a result of the viscosity of the glue, the inner surface of the dispensing syringe 10 having a given water miscibility, the cohesive force of the molecules of glue, the smallest sectional area of the syringe stem, and the lagging and capillarity phenomena.

Since the front end 13 of the dispensing syringe 10 has a polymerizing curved surface 16, of which the sectional area is used for limiting the flow of glue so as to prevent the glue from dripping out during dispensing:. After each dispensing, the polymerizing-curved surface 16 in the front end 13 will cause the glue to have a cohesion; as soon as the glue is in contact with the atmosphere under room temperature, it will generate a polymerization and seal the front end 13. After use, the dispensing syringe 10 can be closed with a sealing pad 19 in the syringe cap 18, i.e., the sealing pad 19 and the flat opening 12 will be closed together to prevent the glue from being in contact with the atmosphere. The dispensing syringe 10 can be used again upon the syringe cap 18 being removed.

According to the aforesaid structure, the glue therein should have a viscosity coefficient ranging from 0.5 to 1.0 poise (1 poise= 100 CPS.), which can provide a better result desired. This invention has been described with the embodiment as mentioned above, which has novel features and a novel structure; therefore, it is deemed different from the conventional device of the kind in terms of structure, and has a high novelty.

I claim:

1. An improved dispensing syringe for a fluid glue comprising:

a syringe seat having a conic cylinder opening in one end thereof, and a contact surface and a guide hole in other end thereof; said contact surface and said guide hole being used for mounting a syringe stem to be glued in place with a glue;

said syringe stem, of which one end having a flat opening, and other end thereof having a bevel opening; said flat opening located on outer end of said syringe seat; having a given length between said flat opening and said syringe seat; a front end of said syringe stem having a curved surface for providing a cohesion after each dispensing of a glue made of cyanoacrylate; said bevel opening located in center of said conic cylinder opening;

a syringe cap which being an elongate cylinder cap, having a sealing pad mounted in the inner bottom thereof; opening end of said syringe cap being mounted on outer end of said syringe seat;

said sealing pad made of a material not becoming polymerized with said glue of cyanoacrylate, and being fastened in inner bottom of said syringe cap; having a: blind hole facing opening end of said syringe cap for closing said fiat opening of said front end;

a guide sleeve having a cylindrical surface and a plurality of ribs, and a conic through-hole in center thereof; said conic through-hole having an end surface between outer end and said cylindrical surface; said ribs facititating said guide sleeve fastened next to said sealing pad in said syringe cap.

2. An improved dispensing syringe for a fluid glue as claimed in claim 1, wherein said sealing pad in said syringe cap is made of a silicon rubber to prevent from having polymerization with said glue (cyanoacrylate); said sealing pad having a blind hole facing the opening of said syringe cap, and said blind hole having a given depth and a diameter slightly less than that of said front end; said sealing pad able to seal said flat opening of said syringe stem because of having a given elasticity so as to prevent said cyanoacrylate from contact with atmosphere.

3. An improved dispensing syringe for a fluid glue as claimed in claim 1, wherein said front end of said syringe stem has a polymerizing curved surface including several resistant curved surfaces, which being symmetrically arranged in said syringe stem coaxially and radially; each said resistant curved surface being formed by means of a tangent line of several resistant beads; said resistant beads in center part of said front end having a maximum diameter to form into: a: smallest sectional area; said resistant beads on both sides of said resistant beads in said center part having a smaller diameter.

4. An improved dispensing syringe for a fluid glue as claimed in claim 1, wherein said syringe stem of said dispensing syringe has a said front end, which including a said polymerizing curved surface formed by means of two said symmetrical recess curved surfaces; said two recess curved surfaces being arranged in a longitudinal symmetry, i.e., in said front end, said recess curved surfaces having a wide-and-curved flat portion in center of said flat portion, a smallest sectional area being formed into said throat portion; outer end of said flat portion being a divergent portion, while inner end thereof being a convergent portion.

* * * * *